United States Patent [19]

Miura et al.

[11] Patent Number: 4,508,682

[45] Date of Patent: Apr. 2, 1985

[54] METHOD FOR MAKING COMPOSITE MATERIAL INCLUDING MATRIX METAL AND METAL CORED CERAMIC SURFACED FINE POWDER MATERIAL

[75] Inventors: Hirohisa Miura; Hiroshi Satou; Toshio Natsume; Hidenori Katagiri, all of Toyota, Japan

[73] Assignee: Toyota Jidosha Kabushiki Kaisha, Toyota, Japan

[21] Appl. No.: 481,466

[22] Filed: Apr. 1, 1983

[30] Foreign Application Priority Data

Apr. 2, 1982 [JP] Japan ..... 57-054874

[51] Int. Cl.[3] ..... B22F 9/00; C22C 23/00

[52] U.S. Cl. ..... 420/590; 75/67 R; 75/0.5 R; 75/0.5 B; 427/255.2; 427/255.1

[58] Field of Search ..... 427/216, 217, 212, 210, 427/255.1, 255.2; 75/67 R, 0.5 B, 0.5 BA, 0.5 R; 420/590

[56] References Cited

U.S. PATENT DOCUMENTS 4,353,938 10/1982 Sterling et al. ..... 427/214
4,440,800 4/1984 Morton et al. ..... 427/13

FOREIGN PATENT DOCUMENTS 802133 12/1968 Canada ..... 420/590
25620 7/1971 Japan ..... 75/0.5 B

*Primary Examiner*—L. Dewayne Rutledge
*Assistant Examiner*—Christopher W. Brody
*Attorney, Agent, or Firm*—Oblon, Fisher, Spivak, McClelland & Maier

[57] ABSTRACT

A composite material including matrix metal and ceramic surface - metallic core fine powder material is disclosed, composed of fine particles each having a metallic core and a ceramic surface layer, in which the average value of the ratio of the thickness of the surface layer of a powder particle to the radius of the particle is substantially greater than 0.05, dispersed within a matrix of matrix metal. A method and an apparatus for making this material from matrix metal, core metal, and a gas which combines with the core metal to form the ceramic outer layers of the particles are also described, in which a gaseous mixture of vapor of the core metal and the gas is passed through a convergent-divergent nozzle and is thereby rapidly cooled by adiabatic expansion so that the core metal as it solidifies forms metal cores for fine particles while the gas reacts with the outer layers of these particles to form ceramic surface layers, the jet from the nozzle then impacting against the surface of a pool of the molten matrix metal.

14 Claims, 9 Drawing Figures

(x10·000)

(x200·000)

METHOD FOR MAKING COMPOSITE MATERIAL INCLUDING MATRIX METAL AND METAL CORED CERAMIC SURFACED FINE POWDER MATERIAL

BACKGROUND OF THE INVENTION

The present invention relates to a type of composite material including a matrix metal and a fine powder material whose particles have metallic cores and ceramic surface layers, to a method for making it, and to an apparatus for making such a composite material including such a fine powder, for practicing the method. In particular, the present invention relates to such a composite material in which a mixture of core metal in vapor form and a gas are rapidly cooled while also being combined together to form the ceramic outer layers of the particles by rapid expansion through a convergent-divergent nozzle, the jet from the nozzle then impacting against the surface of a pool of the molten matrix metal.

Generally, ceramic type metallic compounds such as alumina, silicon nitride, tungsten carbide, and so on are far superior in heat resistance and wear resistance to metals in general; and accordingly it has often been attempted to construct various structural members of various apparatuses out of composite material in which particles of powder of such ceramics are dispersed in a matrix of metal, or alternatively of sintered material in which particles of powder of such ceramics are sintered together.

However, because powder particles consisting solely of such ceramics are very brittle, because the even dispersion of such ceramic powder particles in the body of the matrix metal is difficult, and because it is not always possible to ensure good contact between such ceramic powder particles and the matrix metal, such composite or sintered materials are not utilized on a wide scale at the present time, although they are used for some tool materials such as cermets.

Now, a solution to this which might be considered might be to form the reinforcing powder particles with metalic cores and ceramic surface layers, and this might overcome the problem of brittleness outlined above, but in practice in the past this has been very difficult. Performing surface treatment on metallic powder particles in order to provide them with ceramic outer layers has not been practicable for the production in any large volume of powder particles with average diameter of no more than a few microns. Now, of course, in the natural state powder particles of metals which have a strong tendency to become oxidized are covered with a layer of oxide on their surfaces, which is actually a ceramic, but since the typical thickness of such an oxide layer is only twenty angstroms or so in the case of aluminum for instance, or ten atomic layers at most, and since such a very thin oxide layer can be easily destroyed when force is applied to the powder particle, therefore the hardness of such particles and of the powder thereof as a whole is low, and such powder is quite insufficient in its properties as material for forming a powder reinforced type composite material or a sintered material.

SUMMARY OF THE INVENTION

Accordingly, it is the primary object of the present invention to provide a composite material including a powder material whose particles have metallic cores and ceramic outer layers, which can avoid the above mentioned disadvantages.

It is a further object of the present invention to provide a composite material including a powder material whose particles have metallic cores and ceramic outer layers, which has good heat resistance.

It is a further object of the present invention to provide a composite material including a powder material whose particles have metallic cores and ceramic outer layers, which has good wear resistance.

It is a further object of the present invention to provide a composite material including a powder material whose particles have metallic cores and ceramic outer layers, which has good toughness.

It is a further object of the present invention to provide a composite material including a powder material whose particles have metallic cores and ceramic outer layers, which has good hardness.

It is a further object of the present invention to provide a composite material including a powder material whose particles have metallic cores and ceramic outer layers, which is not brittle.

It is a further object of the present invention to provide a composite material including a powder material whose particles have metallic cores and ceramic outer layers, and in which the crystalline configuration of said metallic cores is amorphous.

It is a further object of the present invention to provide a composite material including a powder material whose particles have metallic cores and ceramic outer layers, with the ceramic outer layers of the particles being substantially thick.

It is a further object of the present invention to provide a composite material including a powder material whose particles have metallic cores and ceramic outer layers, with the ceramic outer layers of the particles being much thicker than the above described naturally occurring very thin oxide layers on metallic particles.

It is a further object of the present invention to provide a composite material including a powder material whose particles have metallic cores and ceramic outer layers, these particles further being very small.

It is a further object of the present invention to provide a composite material including a powder material whose particles have metallic cores and ceramic outer layers, these particles further being no larger than a few microns.

It is a further object of the present invention to provide a composite material including a powder material whose particles have metallic cores and ceramic outer layers, which can be produced in an efficient fashion.

It is a further object of the present invention to provide a composite material including a powder material whose particles have metallic cores and ceramic outer layers, which can be produced in an economical fashion.

It is a further object of the present invention to provide a composite material including a powder material whose particles have metallic cores and ceramic outer layers, which can be produced in a fashion suitable for mass production.

It is a further object of the present invention to provide a composite material including a powder material whose particles have metallic cores and ceramic outer layers, which can be produced by a continuous process which is suitable for being continuously practiced.

It is a further object of the present invention to provide a composite material including a powder material whose particles have metallic cores and ceramic outer layers, whose particles in particular have cores composed of magnesium metal and outer layers composed of magnesium oxide.

It is a further object of the present invention to provide a composite material including a powder material whose particles have metallic cores and ceramic outer layers, whose particles in particular have cores composed of metallic silicon and outer layers composed of silicon carbide.

Further, it is a set of concomitant objects of the present invention to provide methods for making composite materials including powder materials whose particles have metallic cores and ceramic outer layers, said composite materials being of the types whose provision has been detailed above as one or more of the objects of this invention.

Further, it is a set of concomitant objects of the present invention to provide apparatuses for making composite materials including powder materials whose particles have metallic cores and ceramic outer layers, which can practice such methods whose practice has been detailed above as one or more of the objects of this invention.

According to the most general product aspect of the present invention, these and other objects relating to a product are accomplished by a composite material, composed of fine powder particles embedded in matrix metal, each of the particles having a metallic core and a ceramic surface layer, the average value of the ratio of the thickness of the surface layer of a powder particle to the radius of the particle being substantially greater than 0.05.

Since the particles of this ceramic-metallic fine powder material included in the composite material are very fine, and since each of these particles has a substantially thick surface layer around its metallic core, it is sufficiently hard and at the same time sufficiently tough as a reinforcement material for the composite material. That is, the surfaces of the fine powder particles are ceramic and are therefore sufficiently hard and resistant to heat, which means that when the fine powder material is thus used as reinforcement material in the powder reinforced type composite material the fine powder particles obstruct the movement of dislocations in the matrix metal, and also reduce the occurrence of wear in the matrix metal. Thus the tensile strength, the wear resistance, and other mechanical properties of the composite material are improved, as well as its heat resistance. Further, the cores of the fine powder particles are ceramic, and therefore are fairly soft as compared with their outside layers, and thus the toughness of the fine powder particle body as a whole is appropriate, so that when this fine powder is thus used as reinforcement material in the powder reinforced type composite material the toughness, impact resistance, and other properties of said composite material are greatly improved as compared with a comparable case in which a mass of fine powder particles consisting only of ceramic is used.

Further, according to a particular product aspect of the present invention, these and other objects relating to an product are more particularly and concretely accomplished by a composite material as described above, wherein the average value of the ratio of the thickness of the surface layer of a powder particle to the radius of the particle is substantially greater than 0.1.

According to such a product, since the surface layer is quite thick as compared with the overall radius of the powder particles, i.e. as compared with the thickness of the cores of the powder particles, the above mentioned advantages in strength, thoughness, heat resistance, and so on of the powder particles and of the composite material according to the present invention made thereform can be best realized.

Further, according to a particular product aspect of the present invention, these and other objects relating to an product are more particularly and concretely accomplished by a composite material as described above, wherein the average diameter of the particles is substantially less than 5 microns; and further these and other objects are even more particular accomplished by such a composite material, wherein the average diameter of the particles is substantially less than 1 micron.

According to such a product, the following advantage is realized. Since in a particle dispersion type composite material, generally, the finer are the reinforcing particles (and also the higher the relative density thereof) the stronger is the resultant product, especially at high temperatures, therefore according to this particular specialized feature the product according to the present invention is much improved in terms of strength. This is because the strength of a metallic material can be considered as the resistance against deformation, and deformation is produced by the formation and movement of dislocations, on a microscopic scale. In particular in a powder reinforced type composite material it has been made clear that the strength is improved by the dispersed reinforcing particles obstructing the movement of dislocations. For instance, tensile strength is expressed by equation (1) as shown below:

$$\text{tau}_y = \text{tau}_m + G_m b/\text{lambda} \quad (1)$$

where $\text{tau}_y$ is the yield stress, $\text{tau}_m$ is the yield stress of the matrix metal, b is the size of the Burgers vector, lambda is the average distance between the reinforcing particles, and $G_m$ is the matrix rigidity ratio.

From this equation (1), it is clear that the smaller is the average distance lambda between the dispersed reinforcing powder particles, the greater becomes the tensile strength of the composite material.

Between the size of the dispersed reinforcing powder particles, the volume ratio of these powder particles, and the average distance lambda between the particles, the relation expressed by the following equation (2) holds:

$$\text{lambda} = 2d(1 - Vp)/3Vp \quad (2)$$

where d is the particle size, and Vp is the volume ratio of the particles.

From this equation (2), the greater is the volume ratio Vp of the dispersed fine reinforcing particles, and the smaller is the diameter d of these reinforcing particles, the smaller the average distance between the particles becomes. Hence, from equations (1) and (2), it can be seen that the strength of the particle dispersion type composite material improves as the reinforcing fine powder material becomes finer and is dispersed evenly at higher density. The composite material according to the present invention is in this case far superior to a composite material which is reinforced by particles having a relatively large particle diameter which are made by coating a ceramic material over particles of core metal, which can theoretically be made.

As a particular product according to the product aspect of the present invention, the cores of the particles of the ceramic-metallic composite reinforcing fine powder for the composite material according to this invention may be made of magnesium, while the ceramic outer layers of the particles are made of magnesium oxide. Alternatively, the cores of the particles of the ceramic-metallic composite reinforcing fine powder for the composite material according to this invention may be made of metallic silicon, while the ceramic outer layers of the particles are made of silicon carbide.

Now, according to a method aspect of the present invention, these and other objects relating to a method are accomplished by a method of making a composite material composed of fine powder particles embedded in matrix metal, each of the particles having a metallic core and a ceramic surface layer which is a compound of the metal composing said core and another element, the average value of the ratio of the thickness of the surface layer of a powder particle to the radius of the particle being substantially greater than 0.05, wherein said core metal in a gaseous form is mixed with said another element in the gaseous state, the resulting mixture being then passed through a convergent-divergent nozzle and being thereby rapidly cooled by adiabatic expansion, and blowing as a jet against the free surface of a molten mass of said matrix metal.

According to such a method, as the gaseous mixture of the metal and the other element is rapidly so cooled by adiabatic expansion as it passes through the convergent-divergent nozzle, particles condense out of the metal and the other element reacts with the outsides of the particles to form a ceramic outer layer, and then these particles are immediately mixed in with the matrix metal. Thus, because the particles are formed in a protective environment and are brought into contact with the matrix metal as soon as they are made, before the proneness to reaction of their surfaces drops, thereby the wetting of the contact between the particles and the matrix metal is very good. Accordingly, the composite material produced has excellent adherence of the reinforcing particles to the matrix metal, with no abnormal wear due to dropping out of the reinforcing particles occurring. Since the method can be performed in a continuous fashion, it provides composite material including ceramic-metallic composite fine reinforcing powder economically and practically in a way which is suitable for mass production, and no post-pulverization is required. Further, by suitably adjusting the parameters of the process such as the temperature and the pressure of the mixture before and after the adiabatic expansion through the convergent-divergent nozzle, it is possible to obtain composite materials including ceramic-metallic composite fine powder reinforcing particles which have various different size and configuration characteristics, and whose cores are amorphous.

Further, according to another method aspect of the present invention, these and other objects relating to a method are more particularly and concretely accomplished by a method of making a method of making a composite material composed of fine powder particles embedded in matrix metal, each of the particles having a metallic core and a ceramic surface layer which is a compound of the metal composing said core and another element, the average value of the ratio of the thickness of the surface layer of a powder particle to the radius of the particle being substantially greater than 0.05, wherein said core metal in a gaseous form is passed through a first convergent-divergent nozzle and is thereby rapidly cooled by adiabatic expansion, and is then mixed with said another element in the gaseous state, the resulting mixture being then passed through a second convergent-divergent nozzle and being thereby rapidly cooled by adiabatic expansion, and blowing as a jet against the free surface of a molten mass of said matrix metal.

According to such a method, which may be practiced as an alternative to the method specified above in the event that the particular parameters of the specific metal and the specific other element which are to be used so demand, as will be explained later in this specification, as the vapor of the metal is rapidly cooled as it passes through said first convergent-divergent nozzle, it forms a mist of very fine metal particles, possibly also including some metallic vapor. Then, as the still effectively gaseous mixture of the metal and the other element is again rapidly cooled by adiabatic expansion as it passes through said second convergent-divergent nozzle, again the outsides of the metal particles and the other element react together, so as to produce a ceramic compound outer layer on the metal particles which serve as particle cores. Finally, the jet from the second convergent-divergent nozzle including these composite particles impacts on the surface of the molten matrix metal and the composite particles become mixed in with the matrix metal. Since the method can be performed in a continuous fashion, it again provides composite material including ceramic-metallic composite fine reinforcing powder economically and practically in a way which is suitable for mass production, and no post-pulverization is required. Again, because the reinforcing powder particles are formed in a protective environment and are brought into contact with the matrix metal as soon as they are made, before the proneness to reaction of their surfaces drops, thereby the wetting of the contact between the particles and the matrix metal is very good, and accordingly again the composite material produced has excellent adherence of the reinforcing particles to the matrix metal, with no abnormal wear due to dropping out of the reinforcing particles occurring. Further, by suitably adjusting the parameters of the process such as the temperature and the pressure of the mixture before and after the adiabatic expansion through the convergent-divergent nozzle, again it is possible to obtain composite material including reinforcing ceramic-metallic composite fine powder particles which have various different size and configuration characteristics, and whose cores are amorphous.

Now, according to various particular applications of the methods of the present invention, the metal and the other element which are reacted or alloyed together may be any suitable combination of a metal and an element which react together suitably, and in particular the metal may be magnesium while the other element is oxygen, or the metal may be metalic silicon while the other element is carbon. Further, the other element may be supplied not only as a gas of itself alone but as one component of a compound gas; for example, in the case that the other element is carbon, it may be supplied in the form of carbon monoxide.

Further, according to an apparatus aspect of the present invention, these and other objects relating to an apparatus are accomplished by an apparatus for making a composite material composed of fine powder particles embedded in matrix metal, each of the particles having a metallic core and a ceramic surface layer which is a compound of the metal composing said core and another element, the average value of the ratio of the thickness of the surface layer of a powder particle to the radius of the particle being substantially greater than 0.05, comprising: a reaction chamber which can contain a source of metal vapor; a means for heating said reaction chamber; a means for introducing gas into said reaction chamber; a condensation chamber; a convergent-divergent nozzle leading from said reaction chamber to said condensation chamber; and a matrix metal bath, within said condensation chamber, opposing the outlet end of said convergent-divergent nozzle.

According to such an apparatus, the method first described above may be conveniently performed by charging the metal into the reaction chamber, heating it up by said heating means, supplying said other element in a gas into said reaction chamber, and venting the resultant mixture of metal vapor and said other element into said condensation chamber via said convergent-divergent nozzle, the resulting ceramic-metallic compound fine powder impacting against the surface of the molten matrix metal and being mixed thereinto. As the gaseous mixture of the metal and the other element is rapidly so cooled by adiabatic expansion as it passes through the convergent-divergent nozzle, particles of the metal condense out of the vapor, while the other element reacts with the outsides of these particles to form the ceramic outer layer thereof.

Further, according to another apparatus aspect of the present invention, these and other objects relating to an apparatus are more particularly and concretely accomplished by an apparatus for making a composite material composed of fine powder particles embedded in matrix metal, each of the particles having a metallic core and a ceramic surface layer which is a compound of the metal composing said core and another element, the average value of the ratio of the thickness of the surface layer of a powder particle to the radius of the particle being substantially greater than 0.05, comprising: a first reaction chamber which can contain a source of metal vapor; a first means for heating said first reaction chamber; a second reaction chamber; a means for introducing gas into said second reaction chamber; a condensation chamber; a first convergent-divergent nozzle leading from said first reaction chamber to said second reaction chamber; a second convergent-divergent nozzle leading from said second reaction chamber to said condensation chamber; and a matrix metal bath, within said condensation chamber, opposing the outlet end of said second convergent-divergent nozzle.

According to such an alternative apparatus, the method secondly described above may be conveniently performed by charging the metal into the first reaction chamber, heating it up by said heating means, and venting the resultant metal vapor through said first convergent-divergent nozzle into said second reaction chamber. As the vapor of the metal is rapidly cooled as it passes through said first convergent-divergent nozzle, it forms a mist of very fine metal particles, possibly also including some metallic vapor. Then said other element which is a gas is supplied into said second reaction chamber, and the resultant mixture of metal mist (and possibly vapor) and said other element in said second reaction chamber is vented into said condensation chamber via said second convergent-divergent nozzle. As the gaseous mixture of the metal mist and the other element is rapidly so cooled by adiabatic expansion as it passes through the second convergent-divergent nozzle, the outer surfaces of the metal particles and the other element react together to form ceramic outer layers on the particles, and the resulting ceramic-metallic composite fine powder impacting against the surface of the molten matrix metal and being mixed thereinto.

BRIEF DESCRIPTION OF THE DRAWINGS

The present invention will now be shown and described with reference to several preferred embodiments of the product, of the method, and of the apparatus thereof, and with reference to the illustrative drawings. It should be clearly understood, however, that the description of the preferred embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

DESCRIPTION OF THE PREFERRED EMBODIMENTS

Figure 1:
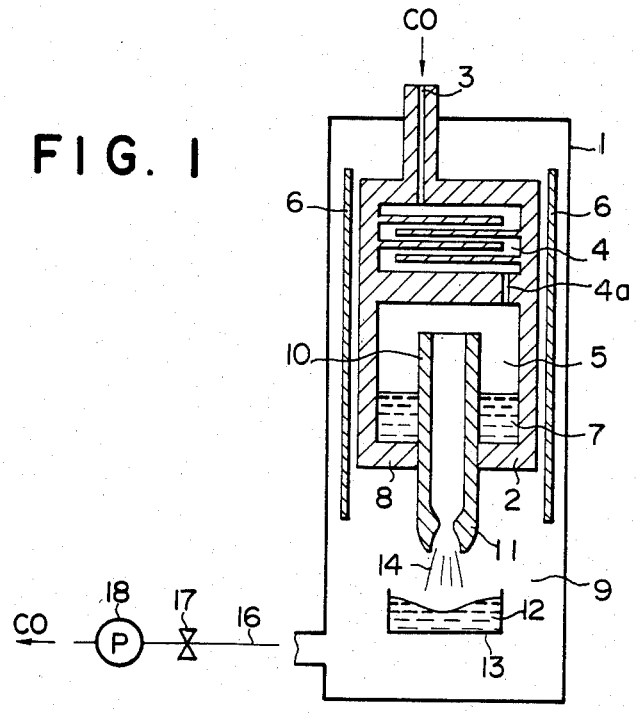
FIG. 1 is a schematic structural diagram, showing the first preferred embodiment of the apparatus according to the present invention for making a composite material according to the first preferred embodiment of the present invention including composite fine powder particles whose particles have metallic cores and ceramic outer layers, which practices the first preferred embodiment of the method according to the present invention.

The present invention will now be described with reference to two preferred embodiments each of the product, the method, and the apparatus thereof, and with reference to the appended drawings. However, first a general discussion of the particular operational problems inherent in the production of the reinforcing composite powder particles will be given, along with an outline of the general solutions discovered by the present inventors.

In a prior art concept developed by the present inventors and others, for which previous concept U.S. patent application Ser. No. 06/471003 has been filled previously to the filing of the present application, there was disclosed a method of making fine powder of a compound of a metal and another element by rapidly cooling a gaseous mixture of the metal and the element and causing them to react with one another while being very rapidly cooled by being passed through a convergent-divergent nozzle. Further, in the abovementioned patent application ways were proposed of substantially improving the purity of the metallic compound fine powder by using various special forms of convergent-divergent nozzles. Now, the present invention basically uses a somewhat similarly constructed apparatus for producing quite a different type of fine powder for incorporation into the product according to the present invention, by operating the convergent-divergent nozzle in particular temperature and pressure conditions so as to cause metallic particles to be condensed out of the metallic vapor in the mixture gas while at the same time another element in the mixture gas reacts with the surface layers of these condensing particles to form a ceramic compound.

As has been explained above, either the composite fine powder incorporated in the product according to the present invention can be produced by passing a mixture of vapor of the core metal and a gas for combining with it through just one convergent-divergent nozzle, so that while the mixture gas is being thus rapidly cooled by adiabatic expansion and while metallic particles are condensing out of it the outer surface layers of these particles are being reacted with an element included in the gas to form a ceramic layer, or alternatively the composite fine powder incorporated in the product according to the present invention can be produced by first passing only vapor of the core metal through a first convergent-divergent nozzle, so as to condense at least the cores of metallic particles out of it, and then mixing with the resultant powder particle-vapor mixture a gas for combining with it and possibly reheating the mixture and then passing said mixture through a second convergent-divergent nozzle, so that while this mixture is being thus rapidly cooled by adiabatic expansion and while metallic particles are continuing to condense out of it the outer surface layers of these particles are being reacted with an element included in the gas to form a ceramic layer. In particular, since the particles of the fine powder made in this way have a high degree of surface reactivity, the particles have a strong affinity with matrix metal for embedding them into, and can make a good contact with such matrix metal, and therefore they can be well and evenly dispersed in such matrix metal and adhere well thereto, so as to form the product according to the present invention. And further, because the jet including the reinforcing powder particles agitates the pool of molten matrix metal, thereby the reinforcing powder particles become well mixed with the matrix metal, thus producing an end product of highly uniform characteristics. Thus, since no separate step of mixing the matrix metal with the reinforcing powder particles is required, the cost of this process is reduced as compared with the cost of a conventional process for making powder reinforced composite material. Finally, by making the fine powder particles in this way, it is possible to ensure that the metal making up the cores of the powder particles is in the amorphous crystalline state.

Now, the way in which rapidly cooling a gaseous mixture of a metal vapor and a gas containing at least another element is effective for obtaining extremely fine composite powder for reinforcing the composite material according to the present invention will be explained in what follows with regard to, in particular, the production of silicon carbide fine composite powder from a mixture of metallic silicon gas and carbon monoxide gas by rapidly cooling it.

Because in the method of the present invention the metallic silicon is rapidly converted from the vaporized state to the solid state by rapidly cooling the silicon vapor, the method according to this invention can practically and economically produce extremely fine composite reinforcing powder for the composite material according to the present invention which has an extremely fine particle diameter and also has substantially uniform particle diameter.

Now, the optimum temperature and pressure conditions for the gaseous mixture before and after the rapid cooling, i.e. before and after the adiabatic expansion through the convergent-divergent nozzle, will be discussed, with reference to the production of silicon carbide fine composite powder.

The temperature and pressure conditions at which silicon and carbon monoxide react together or not and at which the resultant silicon carbide either breaks up or stays in the reacted state are determined by the second law of thermodynamics. In other words, the chemical reaction between metallic silicon vapor and carbon monoxide gas can be expressed in the following formula (3):

$$(Si)+2(CO)=<SiC>+(CO_2) \quad (3)$$

The change of free energy dF in this formula may be expressed by the following formula (4):

$$dF=dF_0+RT\ln((P_{CO2})/(P_{Si}\cdot P_{CO}2)) \quad (4)$$

wherein:

$dF_0$ is the reference free energy change;

R is the gas constant;

T is the temperature in degrees Kelvin;

$P_{Si}$ is the partial vapor pressure of metallic silicon;

$P_{CO}$ is the partial pressure of carbon monoxide gas; and $P_{CO2}$ is the partial pressure of carbon dioxide gas.

This reduces to the following formula (5):

$$dF = 163518 + 5.32T \log T - 109.12T \quad (5)$$

In this formula (5), silicon carbide is stable as a solid and carbon dioxide as a gas when dF is negative, while metallic silicon vapor as a gas and carbon monoxide as a gas are stable when dF is positive. And the chemical reaction becomes faster with increase in temperature and slower with decrease in temperature, and a certain temperature and pressure condition exists below which substantially no chemical reaction takes place even when dF is negative.

Therefore, in the method of making composite material according to the present invention, it will be clear that by properly selecting the temperature and pressure conditions before the gaseous mixture enters the convergent-divergent nozzle and after the gaseous mixture leaves the convergent-divergent nozzle, and by properly selecting the shape and the dimensions of the divergent nozzle and its operating conditions, it is possible to produce fine composite reinforcing powder with particles which have metallic cores and ceramic surface layers, by appropriately controlling the time during which the mixture gas is kept under temperature and pressure conditions which allow the ceramic forming chemical reaction to take place between the outside surfaces of condensed metal particles and said other element present in the mixture gas, and by controlling the timing of cooling down the mixture gas to a temperature and pressure range in which said ceramic forming chemical reaction no longer takes place, after first keeping the mixture gas for an appropriate time in such temperature and pressure conditions as will promote the formation of small metallic particles therein by condensation from the metallic vapor without substantial occurrence of the ceramic forming reaction at that time. Further, if the temperature and pressure of the region in which the metallic vapor and the other element are stable without combining together is located in a temperature and pressure range which is difficult to obtain on an industrial basis, for instance in the region of 3000° C., then a method of obtaining composite fine reinforcing powder at a relatively low temperature in the same way as in the case in which said region in which the metallic vapor and the other element are stable without combining together is located in a temperature and pressure range which is reasonably easy to obtain industrially can be: to connect in series two units each comprising a reaction chamber and a convergent-divergent nozzle, to produce metallic vapor at a temperature which is practically achievable on an industrial basis in the first reaction chamber, to vent this metallic vapor to the second reaction chamber via a first convergent-divergent nozzle while rapidly cooling it so as to form metallic powder as a fine mist which is mixed with metallic vapor remnants, to mix this fine mist metallic powder and gaseous remnants in the second chamber with the gas containing the other element, and then to vent this mixture through a second convergent-divergent nozzle while again rapidly cooling it as the metallic mist particles and the other element are reacting together. In this case, the mixture may be reheated before passing through the second convergent-divergent nozzle, and since the complete evaporation of the condensed metallic particles does not occur immediately their inner parts still remain as cores for being surrounded with ceramic compound as they pass down through said second convergent-divergent nozzle.

In other words, in the first above described case utilizing just one convergent-divergent nozzle, the cores of the powder particles are first produced by cooling the mixture gas in the convergent-divergent nozzle with a priority being given to the production of metallic particles, and then the ceramic outer layers are formed on the metallic powder particle cores by further cooling the mixture gas with a priority being given to the formation of ceramic compound. This can be done by setting the partial pressure of the metallic vapor in the mixture gas before it passes through the convergent-divergent nozzle at a slightly higher level than that at which fine particles which are 100% composed of ceramic compound are produced.

Further, by properly selecting the temperature and pressure conditions before the gaseous mixture enters the convergent-divergent nozzle and after the gaseous mixture leaves the convergent-divergent nozzle, and by properly selecting the shape and the dimensions of the divergent nozzle and its operating conditions, it is possible to produce fine composite reinforcing powder particles which may have any particular desired average diameters, average ratios of thickness of surface ceramic layer to diameter, and other parameters.

THE CONSTRUCTION OF THE FIRST APPARATUS EMBODIMENT

In FIG. 1 there is shown a schematic structural view of an apparatus for making composite material including composite fine reinforcing powder and matrix metal which is the first preferred embodiment of the apparatus of the present invention, for practicing the first preferred embodiment of the method according to the present invention for producing the first preferred embodiment of the product according to the present invention, which is a composite material including composite fine powder and matrix metal. In this figure, the reference numeral 1 denotes a furnace shell which is substantially formed as a closed container, and a melting pot or crucible 2 is provided within this furnace shell 1. The upper part of this melting pot 2 is formed as a gas preheating chamber 4, which is of a convoluted form for the sake of good heat transfer, to the upper part of which a gas introduction port 3 is communicated; a pipe leads from this gas introduction port 3 to the outside. The lower part of the melting pot 2 is formed as a reaction chamber 5, and an opening 4*a* leads from the gas preheating chamber 4 to the reaction chamber 5 to allow gas to flow therebetween. A heater 6 is disposed generally around the melting pot 2, so as to heat up the melting pot 2 and the preheating chamber 4 and the reaction chamber 5 defined therein.

The bottom 8 of the reaction chamber 5 has a conduit 10 set thereinto, and this conduit 10 leads downwards to communicate the reaction chamber 5 with a condensation chamber 9 defined within the furnace shell 1 below the melting pot 2. Particularly according to an important principle of the present invention, the lower end of this conduit 10 is formed as a convergent-divergent nozzle 11 of the above described sort. Within the condensation chamber 9, below and opposed to the lower end of the convergent-divergent nozzle 11, there is provided a matrix metal bath 12, which is a vessel whose open side faces upwards. A side lower part of the condensation chamber 9 is communicated, via a conduit 16 and a control valve 17, to a vacuum pump 18.

THE OPERATION OF THE FIRST APPARATUS EMBODIMENT

The apparatus according to the first preferred embodiment of the apparatus aspect of the present invention is generally used as follows. First, metal for forming powder as will be understood in detail later is charged into the reaction chamber 5 of the melting pot 2, and metal for use as matrix metal is charged into the matrix metal bath 12, and then the heater 6 is operated so as to heat up the melting pot 2 and the powder forming metal charged therein to a predetermined temperature $T_1$, so as to melt this powder forming metal into a pool of molten powder metal 7, and so as further to boil said molten powder metal 7; and further another heater not shown in the figure is operated so as to melt the matrix metal within the matrix metal bath 12 into a pool of molten matrix metal 13. Gas is then flowingly introduced through the gas introduction port 3 into the gas preheating chamber 4, the flow rate of this gas introduction being determined as will be understood later according to the control of the valve 17 which controls the removal of this gas from the other end of the apparatus by the action of the vacuum pump 18 which is being operated. This gas is heated up within the gas preheating chamber 4, and then passes in the heated state through the opening 4*a* from the gas preheating chamber 4 into the reaction chamber 5, wherein it mixes with the vapor of the boiling powder metal pool 7 which is being emitted from the free surface thereof.

This mixture gas is then ejected from the reaction chamber 5, according to the difference of pressures between the interior of the reaction chamber 5 which is at a predetermined pressure $P_1$ and the interior of the condensation chamber 9 which is at a predetermined pressure $P_2$ substantially lower than the pressure $P_1$, through the conduit 10 and through the convergent-divergent nozzle 11 at the lower end of said conduit 10 into the condensation chamber 9, and sprays out of the convergent-divergent nozzle 11 as a jet 14 which impinges against the upper free surface of the pool 13 of molten matrix metal in said matrix metal bath 12. As this mixture gas passes through the convergent-divergent nozzle 11, as explained previously it reaches a supersonic speed and expands adiabatically very quickly, while the metal vapor and the introduced gas react together chemically while at the same time the metal vapor is being condensed into fine metal particles, and is cooled down by this adiabatic expansion to a second temperature $T_2$, and the product of this reaction forms a fine powder by condensation caused by this cooling, said powder being composed of very small particles which have cores formed of condensed metal vapor of the powder metal 7 charged in the reaction chamber 5 of the melting pot 2 and which have coatings around these cores of a chemical compound of said powder metal and of the gas injected through the port 3.

The fine powder produced, after impinging on the free surface of the pool 13 of molten matrix metal in the matrix metal bath 12, becomes mixed with this matrix metal, and because of the high speed of this jet which agitates this pool 13 of molten matrix metal this fine powder becomes very well and quickly mixed therewith, also becoming intimately associated therewith because the surfaces of the powder particles (which are formed as compound particles as explained above) are very fresh, since these powder particles have just been formed. The excess gas which has not become combined with metal vapor then passes out of the condensation chamber 9 through the conduit 16 under the control of the valve 17, being sucked out of the apparatus by the operation of the vacuum pump 18. The sucking rate of the vacuum pump 18 and the opening amount of the valve 17 and the injection flow rate of the gas through the gas introduction port 3 are all controlled so as to maintain the pressures in the reaction chamber 5 and in the condensation chamber 9 at substantially their respective predetermined desired values $P_1$ and $P_2$.

When the molten matrix metal pool 12 in the matrix metal bath 13 is sufficiently charged with fine powder each of whose particles, according to the principles which have been explained earlier in this specification, consists of a metallic core and a surface layer of ceramic, then the mixture is removed from the apparatus. When this mixture is cooled so that the matrix metal solidifies, it becomes a composite material including a mass of fine powder particles of the above described type set in a matrix of the matrix metal.

DESCRIPTION OF THE FIRST METHOD AND PRODUCT EMBODIMENTS

The apparatus described above according to the first preferred embodiment of the apparatus of the present invention was operated so as to make a composite material consisting of magnesium matrix metal and a mass of fine powder particles dispersed therein which were formed with cores of metallic magnesium covered by surface layers of magnesium oxide, by charging metallic magnesium in the reaction chamber 5 of the melting pot 2, by operating the heater 6, and by injecting carbon monoxide gas (CO) through the gas introduction port 3 into the gas preheating chamber 4. The temperature $T_1$ to which the melting pot 2 and the molten magnesium powder metal pool 7 in the reaction chamber 5 thereof were heated was 900° C., and the rate of flowing in of the carbon monoxide gas and the opening of the valve 17 and the suction of the vacuum pump 18 were controlled so as to keep the pressure $P_1$ within the reaction chamber 5 at approximately 30 torr (with the partial pressure of magnesium vapor $P_{Mg}$ at about 14 to 17 torr) and so as to keep the pressure $P_2$ within the condensation chamber 9 at approximately 1 to 3 torr. Further, magnesium to be used as a matrix metal was charged within the matrix metal bath 13 in the condensation chamber 9, and was melted by the operation of the abovementioned heater which is not shown in the figure so as to form a molten magnesium matrix metal pool 12, being heated to a temperature of about 670° to 700° C.

As explained above, the vaporized magnesium produced by the boiling of the molten magnesium pool 7 mixed within the reaction chamber 5 with the heated carbon monoxide gas flowing thereinto through the aperture 4*a*, and this mixture of magnesium vapor and carbon monoxide gas, while the magnesium vapor was condensing and while also the magnesium and carbon monoxide were reacting chemically, then flowed out through the conduit 10 and through the convergent-divergent nozzle 11 into the condensation chamber 9, attaining a supersonic speed as it passed through the convergent-divergent nozzle 11. A jet flow including a fine powder body of particles condensed out of this reacting mixture gas, these particles having metallic magnesium cores and magnesium oxide coatings around the cores, and this jet flow impinged on the surface of the molten magnesium matrix metal pool 13 within the matrix metal bath 12 as explained above, so that the fine powder particles became intimately mixed therein. Meanwhile, continuously the excess carbon monoxide gas was removed by the vacuum pump 18 to be recycled. Later, when sufficient of this powder had been mixed into the matrix metal pool 12, the resulting composite material was removed from the apparatus as explained above. The temperature $T_2$ to which the mixture gas was cooled by the adiabatic expansion within the convergent-divergent nozzle 11 as it emerged into the condensation chamber 9 was about 250° C. or less.

Figure 2:
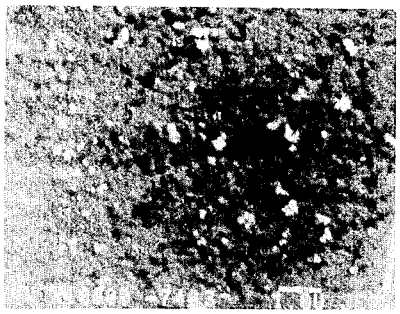
FIG. 2 is an electron photomicrograph at an enlargement of 10,000X, showing a sample of the composite material which is the first preferred embodiment of the product aspect of the present invention, including a reinforcing powder material whose particles have magnesium cores and magnesium oxide surface layers.
Figure 3:
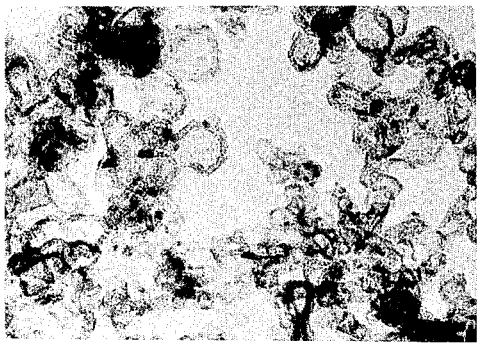
FIG. 3 is an electron photomicrograph at an enlargement of 200,000X, showing a sample of said composite powder which is a reinforcement material in said first preferred embodiment of the product aspect of the present invention, whose particles have magnesium cores and magnesium oxide surface layers.

In FIG. 2, there is shown a scanning electron microscope photograph of the resulting composite material, which is the first preferred embodiment of the product according to the present invention, at an enlargement of 10,000X. It can be seen from this figure that the powder particles (i.e., the white portions in this figure) are evenly dispersed within the matrix metal. Further, in FIG. 3, there is shown a transmission electron microscope photograph of the composite fine powder, at an enlargement of 200,000X. With regard to these fine powder particles, the average particle diameter was 0.03 microns, the average thickness of the surface layer of magnesium oxide was 40 to 60 angstroms, and the average value of the ratio of the thickness of the surface layer of magnesium oxide to the particle diameter was 0.13 to 0.2. Since the fine powder particles were extremely small, it was of course impossible actually to measure their surface hardness and their toughness, but since as can be seen from the phoromicrograph of FIG. 3 these fine powder particles were composed from cores of magnesium metal surrounded by surface layers of magnesium oxide ceramic, it is presumed that the surface of the particles had good hardness and heat resistance as would be appropriate for magnesium oxide, while the body as a whole of the fine powder particles had good toughness, better than that of a comparable fine powder body consisting solely of magnesium oxide.

Now, the following results were obtained, when the properties of the composite material (with volume ratio of dispersed powder material about 4%) were compared with the properties of other materials. First, with regard to hardness at room temperature: the hardness of the composite material according to this first preferred embodiment of the product aspect of the present invention was 140 to 160 Hv, while the hardness of pure magnesium was 30 to 40 Hv and the hardness of a comparison composite material (also with volume ratio of dispersed powder material about 4%) whose reinforcing powder material was powder of particles of 100% magnesium oxide and whose matrix metal was pure magnesium was 35 to 45 Hv. Next, with regard to melting point: the melting point of the composite material according to this first preferred embodiment of the product aspect of the present invention was 800° C., while the melting point of pure magnesium was 650° C. and the melting point of the comparison composite material was also 650° C. Finally, with regard to wear, as measured by the LFW method with a load of 15 kg and using lubrication by oil, for a period of 30 minutes: the wear of the composite material according to this first preferred embodiment of the product aspect of the present invention was 1 mg, while the wear of pure magnesium was 18 mg and the wear of the comparison composite material was 5 mg. Further, by observation of the surface of each of the test pieces after the wear test, it was determined that peeling off and dropping out of the reinforcing powder particle material was much less in the case of the composite material according to this first preferred embodiment of the product aspect of the present invention than in the case of the comparison composite material (also with volume ratio of dispersed powder material about 4%) whose reinforcing powder material was powder of particles of 100% magnesium oxide and whose matrix metal was pure magnesium.

THE CONSTRUCTION OF THE SECOND APPARATUS EMBODIMENT

Figure 4:
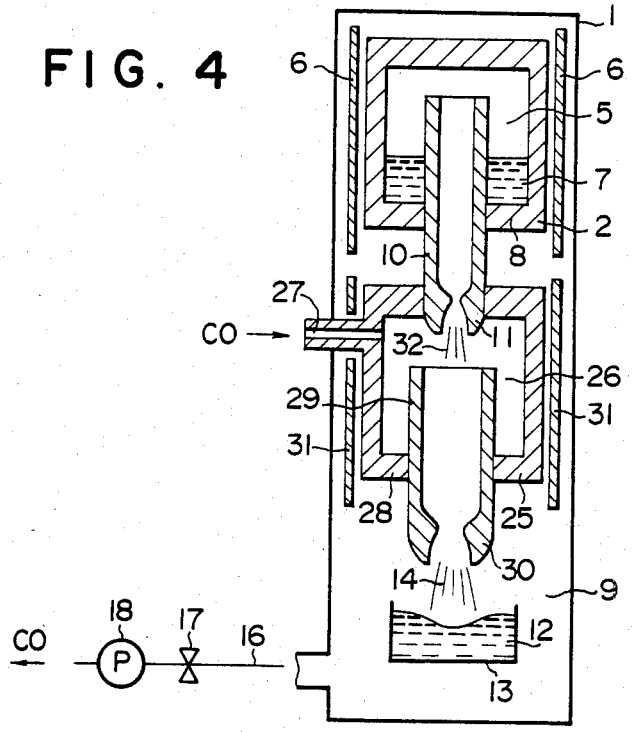
FIG. 4 is a schematic structural diagram, similar to FIG. 1, showing the second preferred embodiment of the apparatus according to the present invention for making a composite material according to the present invention including composite fine powder whose particles have metallic cores and ceramic outer layers, which practices the second preferred embodiment of the method according to the present invention.

In FIG. 4 there is shown a schematic structural view of an apparatus for making composite material including composite fine powder and matrix metal which is the second preferred embodiment of the apparatus of the present invention, for practicing the second preferred embodiment of the method according to the present invention for producing the second preferred embodiment of the product according to the present invention, which is a composite material including composite fine powder and matrix metal. In FIG. 4, parts which correspond to parts of the first preferred embodiment of the apparatus of the present invention shown in FIG. 1, and which have the same functions, are designated by the same reference numerals.

In this second preferred apparatus embodiment, which will be described in detail because it is substantially different in structure from the first preferred embodiment shown in FIG. 1, the reference numeral 1 again denotes a furnace shell which is substantially formed as a closed container, and a first melting pot or crucible 2 and a second melting pot or crucible 25 are provided within this furnace shell 1, with the first melting pot 2 above the second melting pot 25. The first melting pot 2 is formed with a first reaction chamber 5 in its interior space, and the second melting pot 25 is formed with a second reaction chamber 26 in its interior space. A first heater 6 is disposed generally around the first melting pot 2, so as to heat up the first melting pot 2 and the first reaction chamber 5 defined therein, and a second heater 31 is disposed generally around the second melting pot 25, so as to heat up the second melting pot 25 and the second reaction chamber 26 defined therein.

The bottom 8 of the first reaction chamber 5 has a first conduit 10 set thereinto, and this first conduit 10 leads downwards to communicate the first reaction chamber 5 with the second reaction chamber 26 defined within the second melting pot 25. Particularly according to an important principle of the present invention, the lower end of this first conduit 10 is formed as a first convergent-divergent nozzle 11 of the above described sort. Into the second reaction chamber 26 there opens a gas introduction port 27. The bottom 28 of the second reaction chamber 26 has a second conduit 29 set thereinto, and this second conduit 29 leads downwards to communicate the second reaction chamber 26 with a condensation chamber 9 defined within the furnace shell 1 below the second melting pot 25. Again, particularly according to the principle of the present invention, the lower end of this second conduit 29 is formed as a second convergent-divergent nozzle 30, again of the above described sort. Within the condensation chamber 9, below and opposed to the lower end of the second convergent-divergent nozzle 30, there is provided a matrix metal bath 12, which is again a vessel whose open side faces upwards. A side lower part of the condensation chamber 9 is again communicated, via a conduit 16 and a control valve 17, to a vacuum pump 18.

Although the second preferred apparatus embodiment as shown in FIG. 4 only has the end of the first convergent-divergent nozzle 11 opposing the inlet of the second conduit 29 at a certain distance away therefrom, as a variation it would be possible for the tip end portion of the first convergent-divergent nozzle 11 to actually project into the upper end portion of the second conduit 29. In such a case, the jet flow 32 flowing at high speed out of the first convergent-divergent nozzle 11 directly into the second conduit 29 would suck in a flow of the gas within the second reaction chamber 26, thereby ensuring good mixing action therefor.

THE OPERATION OF THE SECOND APPARATUS EMBODIMENT

The apparatus according to the second preferred embodiment of the apparatus aspect of the present invention is generally used as follows. First, metal for forming powder as will be understood in detail later is charged into the first reaction chamber 5 of the first melting pot 2, and metal for use as matrix metal is charged into the matrix metal bath 12, and then the first heater 6 is operated so as to heat up the first melting pot 2 and the powder forming metal charged therein to a predetermined temperature $T_1$, so as to melt this powder forming metal into a pool of molten powder metal 7, and so as further to boil said molten powder metal 7; and further the second heater 31 is operated so as to heat up the interior of the second melting pot 25 to a predetermined temperature $T_2$; and also another heater not shown in the figure is operated so as to melt the matrix metal within the matrix metal bath 12 into a pool of molten matrix metal 13. Gas is then flowingly introduced through the gas introduction port 27 into the second reaction chamber 26, the flow rate of this gas introduction being determined as will be understood later according to the control of the valve 17 which controls the removal of this gas from the other end of the apparatus by the action of the vacuum pump 18 which is being operated. Meanwhile, vapor produced by the boiling of the powder metal pool 7 within the first reaction chamber 5 is ejected from the first reaction chamber 5, according to the difference of pressures between the interior of the first reaction chamber 5 which is at a predetermined pressure $P_1$ and the interior of the second reaction chamber 26 which is at a predetermined pressure $P_2$ substantially lower than the pressure $P_1$, through the conduit 10 and through the first convergent-divergent nozzle 11 at the lower end of said first conduit 10 into the second reaction chamber 26, and sprays out of the first convergent-divergent nozzle 11 as a jet 32 into the second reaction chamber 26. As this metal vapor passes through the first convergent-divergent nozzle 11, as explained previously it reaches a supersonic speed and expands adiabatically very quickly, and thus this metal vapor is at least partially condensed into fine metal particles, and is cooled down by this adiabatic expansion to a fairly low temperature, forming a fine powder by condensation caused by this cooling, said powder being composed of very small particles formed of condensed metal vapor of the powder metal 7 charged in the first reaction chamber 5 of the first melting pot 2.

Now, within this second reaction chamber 26, this jet 32 of metal particles and possibly also of residual metallic vapor is quickly reheated again, since the second reaction chamber 26 is being kept at a high temperature $T_2$; and at the same time the gas which is being injected through the gas introduction port 27 is mixed thereinto. By this reheating, a portion of the outer parts of the fine metallic particles may in fact be again vaporized, as the mixture gas is entrained so as to enter the upstream end of the second conduit 29. In any case, the mixture gas is ejected from the second reaction chamber 26, according to the difference of pressures between the interior of the second reaction chamber 26 which is at a predetermined pressure $P_2$ and the interior of the condensation chamber 9 defined within the furnace shell 1 below the second melting pot 25 which is at a predetermined pressure substantially lower than the pressure $P_2$, through the second conduit 29 and through the second convergent-divergent nozzle 30 at the lower end of said second conduit 29 into the condensation chamber 9, and sprays out of the second convergent-divergent nozzle 30 as a jet 14 into the condensation chamber 9, said jet impinging against the upper free surface of the pool 13 of molten matrix metal in the matrix metal bath 12. As this mixture gas passes through the second convergent-divergent nozzle 30, in a similar fashion to that explained previously it reaches a supersonic speed and expands adiabatically very quickly, while the metal vapor and the introduced gas react together chemically while at the same time the metal vapor is again further being condensed into fine metal particles, and is cooled down by this adiabatic expansion to a low temperature, and the product of this reaction forms a fine powder by condensation caused by this cooling, said powder being composed of very small particles which have cores formed of condensed metal vapor of the powder metal 7 charged in the first reaction chamber 5 of the first melting pot 2 and which have coatings around these cores of a chemical compound of said powder metal and of the gas injected through the gas injection port 27.

The fine powder produced, after impinging on the free surface of the pool 13 of molten matrix metal in the matrix metal bath 12, again becomes mixed with this matrix metal, and because of the high speed of this jet which agitates this pool 13 of molten matrix metal this fine powder becomes very well and quickly mixed therewith, also becoming intimately associated therewith because of surfaces of the powder particles (which are formed as compound particles as explained above) are very fresh, since these powder particles have just been formed. The excess gas which has not become combined with metal vapor then again passes out of the condensation chamber 9 through the conduit 16 under the control of the valve 17, being sucked out of the apparatus by the operation of the vacuum pump 18. The sucking rate of the vacuum pump 18 and the opening amount of the valve 17 and the injection flow rate of the gas through the gas introduction port 3 are all controlled so as to maintain the pressures in the first and second reaction chambers 5 and 26 at substantially their respective predetermined desired values $P_1$ and $P_2$.

Again, when the molten matrix metal pool 12 in the matrix metal bath 13 is sufficiently charged with fine powder each of whose particles, according to the principles which have been explained earlier in this specification, consists of a metallic core and a surface layer of ceramic compound of the powder metal and the injected gas, then the mixture is removed from the apparatus. When this mixture is cooled so that the matrix metal solidifies, it becomes a composite material including a mass of fine powder particles of the above described type set in a matrix of the matrix metal.

DESCRIPTION OF THE SECOND METHOD AND PRODUCT EMBODIMENTS

The apparatus described above according to the second preferred embodiment of the apparatus of the present invention was operated so as to make a composite material consisting of magnesium alloy matrix metal and a mass of fine powder particles dispersed therein which were formed with cores of metallic silicon covered by surface layers of silicon carbide, by charging metallic silicon in the first reaction chamber 5 of the first melting pot 2, by operating the first heater 6 and the second heater 31, and by injecting carbon monoxide gas (CO) through the gas introduction port 27 in to the second reaction chamber 26. The temperature $T_1$ to which the first melting pot 2 and the molten silicon powder metal pool 7 in the first reaction chamber 5 thereof were heated was 2500° C., the temperature $T_2$ to which the second reaction chamber 26 thereof was heated was 2000° to 2200° C., and the rate of flowing in of the carbon monoxide gas and the opening of the valve 17 and the suction of the vacuum pump 18 were controlled so as to keep the pressure $P_1$ within the first reaction chamber 5 at approximately 10 to 15 torr and so as to keep the pressure $P_2$ within the second reaction chamber 26 at approximately 3 to 4 torr. Further, magnesium alloy (JIS standard MC2F) to be used as a matrix metal was charged within the matrix metal bath 13 in the condensation chamber 9, and was melted by the operation of the abovementioned heater which is not shown in the figure so as to form a molten magnesium alloy matrix metal pool 12, being heated to a temperature of about 670° to 700° C.

As explained above, the vaporized silicon produced by the boiling of the molten silicon pool 7 in the first reaction chamber 5 flowed out through the first conduit 10 and through the first convergent-divergent nozzle 11 into the second reaction chamber 26, attaining a supersonic speed as it passed through the first convergent-divergent nozzle 11. A jet flow 32 including a fine powder body of metallic silicon particles condensed out of this metal vapor, as it was cooled down by this adiabatic expansion to a fairly low temperature, forming a fine metallic silicon powder by condensation caused by this cooling. Within this second reaction chamber 26, this jet 32 of metallic silicon particles and also of residual silicon vapor was quickly reheated again, since the second reaction chamber 26 was being kept at the high temperature $T_2$ of 2000° to 2200° C.; and at the same time the carbon monoxide gas which was being injected through the gas introduction port 27 was mixed thereinto. By this reheating, a portion of the outer parts of the fine metallic silicon particles started to be again vaporized, as the mixture gas was entrained so as to enter the upstream end of the second conduit 29. This mixture gas was ejected from the second reaction chamber 26, according to the difference of pressures between the interior of the second reaction chamber 26 which was being kept at the predetermined pressure $P_2$ and the interior of the condensation chamber 9 defined within the furnace shell 1 below the second melting pot 25 which was at a predetermined pressure substantially lower than the pressure $P_2$, through the second conduit 29 and through the second convergent-divergent nozzle 30 at the lower end of said conduit 29 into the condensation chamber 9, while the silicon vapor was condensing and while also the silicon and carbon monoxide were reacting chemically, and sprayed out of the second convergent-divergent nozzle 30 as a jet 14. This jet 14 was composed of carbon monoxide gas and silicon vapor and of a spray of powder particles having metallic silicon cores and silicon carbide coatings around the cores, and this jet flow impinged on the surface of the molten magnesium alloy matrix metal pool 13 within the matrix metal bath 12 as explained above, so that the fine powder particles became intimately mixed therein. Meanwhile, continuously the excess carbon monoxide gas was removed by the vacuum pump 18 to be recycled. Later, when sufficient of this powder had been mixed into the matrix metal pool 12, the resulting composite material was removed from the apparatus as explained above.

No particular photomicrograph of the resultant composite material is shown in this specification, but in fact the powder particles were evenly dispersed within the magnesium alloy matrix metal. Further, the average particle diameter was 0.7 microns, the average thickness of the surface layer of silicon carbide was 0.10 microns, and the average value of the ratio of the thickness of the surface layer of silicon carbide to the particle diameter was about 0.14. As before, it was of course impossible to measure the surface hardness and the toughness of the ceramic (silicon carbide) coating on the fine powder particles, but it is presumed that they were good, as is appropriate for the constitution of the particles.

Now, the following results were obtained, when the properties of the composite material (with volume ratio of dispersed powder material about 7%) were compared with the properties of other material. First, with regard to hardness at room temperature: the hardness of the composite material according to this second preferred embodiment of the product aspect of the present invention was 65 to 70 Hv while the hardness of pure magnesium alloy matrix metal was 50 Hv and the hardness of a comparison composite material (also with volume ratio of dispersed powder material about 7%) whose reinforcing powder material was powder of particles of 100% silicon carbide and whose matrix metal was again the same magnesium alloy was 60 to 65 Hv. Next, with regard to strength: the strength of the composite material according to this second preferred embodiment of the product aspect of the present invention was 30 to 33 kg/mm$^2$, while the strength of pure magnesium alloy matrix metal was 24 kg/mm$^2$ and the strength of the comparison composite material was 29 to 30 kg/mm$^2$. Finally, with regard to wear, again as measured by the LFW method with a load of 15 kg and using lubrication by oil, for a test period of 30 minutes: the wear of the composite material according to this second preferred embodiment of the product aspect of the present invention was 1.7 mg, while the wear of pure magnesium alloy matrix metal was 10 mg of the wear of the comparison composite material was 2.0 mg. Further, again, by observation of the surface of each of the test pieces after the wear test, it was determined that peeling off and dropping out of the reinforcing powder particle material was much less in the case of the composite material according to this second preferred embodiment of the product aspect of the present invention than in the case of the comparison composite material (also with volume ratio of dispersed powder material about 7%) whose reinforcing powder material was powder of particles of 100% silicon carbide and whose matrix metal was again magnesium alloy.

VARIATIONS ON THE MATERIALS

Although the specifically discussed and described preferred embodiments of the apparatus, method, and product of the present invention relate to the production of powder particles with ceramic outer layers composed of oxides and carbides, in fact various other possible applications of the present invention are possible, involving the production of powder particles with other types of ceramic outer layers, such as nitrides and borides and so on.

VARIANT NOZZLE CONFIGURATIONS

Now, as will be understood from the above, the apparatuses and processes described above involving the use of convergent-divergent nozzles are very effective for producing composite fine powder of very fine particle diameter. Further, the present inventors have determined that, by utilizing various particular forms of convergent-divergent nozzle as particularly described in the abovementioned patent application, instead of using a conventional type of convergent-divergent nozzle, the conversion of the gaseious mixture into fine composite powder particles is much improved, resulting in a better form of fine composite powder particles. Further, it has been discovered by the present inventors that the use of such novel forms of convergent-divergent nozzle results in much reduced particles size, thus producing finer composite powder particles. Therefore, now a discussion will be made of the various forms of convergent-divergent nozzles shown in FIGS. 5 to 9. In these figures, parts which correspond and which have the same functions are designated by the same reference numerals, sometimes with primes or double primes affixed thereto.

CONSTANT CROSS SECTION PORTION TYPE DIVERGENT NOZZLES

Figure 5:
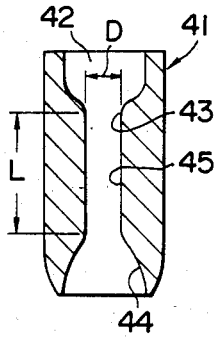
FIG. 5 is an axial sectional view of the convergent-divergent nozzle or Laval nozzle which has a constant cross sectional intermediate portion of the same diameter as its throat and downstream thereof.

Referring to FIG. 5, the convergent-divergent nozzle 41 shown therein has, in order along its axis, an inlet portion 42, a throat portion 43 toward which the inlet portion 42 converges, a constant cross section portion 45 of diameter equal to that of the throat portion 43 and of axial length L which is equal to or greater than the diameter D of the throat portion 43 toward which the inlet portion 42 converges, and an expansion portion 44. The convergent-divergent nozzle 41 shown in FIG. 6 has, in order along its axis, an inlet portion 42, a throat portion 43, a first expansion portion 44, a constant cross section portion 45 of diameter greater than that of the throat portion 43 and of length which is greater than the diameter of the throat portion 43, and a second expansion portion 44'. And the convergent-divergent nozzle 41 shown in FIG. 7 has, in order along its axis, an inlet portion 42, a throat portion 43, a first expansion portion 44, a first constant cross section portion 45 of diameter greater than that of the throat portion 43 and of axial length $L_1$ which is greater than the diameter of the throat portion 43, a second expansion portion 44', a second constant cross section portion 45' of axial length $L_2$ which is also greater than the diameter of the throat portion 43, and a third expansion portion 44''. In all cases, the constant cross section portion or portions are downstream of the throat portion 43 of the convergent-divergent nozzle. And in the first case shown in FIG. 5 the diameter of the constant cross section portion 45 is equal to the diameter of the throat portion 43, while in the other cases, since an expansion portion is interposed between the throat portion 43 and the constant cross section portion, the diameter of the constant cross section portion is greater than the diameter of the throat portion 43; and in the case of the convergent-divergent nozzle shown in FIG. 7 the diameter of the second constant cross section portion 45' is greater than the diameter of the first constant cross section portion 45. In fact, depending upon the particular properties and nature of the fine powder which is to be produced, such a convergent-divergent nozzle having even more than two constant cross sectional portions could be utilized.

The following opinions are held as to why this particular convergent-divergent nozzle configuration is effective.

Figure 6:
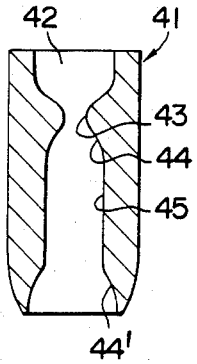
FIG. 6 is an axial sectional view, similar to FIG. 5, showing a convergent-divergent nozzle which has a constant cross sectional intermediate portion of greater diameter than its throat and downstream thereof.
Figure 7:
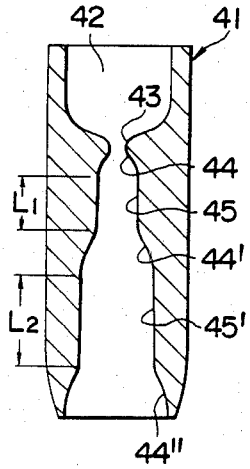
FIG. 7 is an axial sectional view, similar to FIGS. 5 and 6, showing a convergent-divergent nozzle which has a first constant cross sectional intermediate portion of greater diameter than its throat and downstream thereof, and a second constant cross sectional intermediate portion of greater diameter than said first constant cross sectional intermediate portion and downstream thereof.

As a mixture gas consisting of metal vapor and/or mist and the other element to be compounded therewith by being combined with the outside surface layer of particles which are condensing or have condensed out of the metal vapor and/or mist enters into the inlet portion 42 of the convergent-divergent nozzle 41 shown in FIG. 5, according to sucking on the outlet thereof, it reaches a supersonic speed in the region of the throat portion 43, then maintains this supersonic speed as it flows along the constant cross section portion 45 keeping a substantially steady state condition of temperature and pressure and thus reacting and/or mixing very well, and finally is adiabatically expanded in the expansion portion 44, being very quickly cooled by said expansion as explained previously. By this steady state interval of temperature and pressure produced by the provision of the constant cross section portion 44, the reaction and/or mixing of the metal vapor and/or mist and the other element is very well promoted. On the other hand, in the case of the convergent-divergent nozzle 41 shown in FIG. 6, since the first expansion portion 44 is provided between the throat portion 43 and the constant cross section portion 45, the mixture gas consisting of metal vapor and/or mist and the other element to be compounded therewith which has as described above attained a supersonic speed in the throat portion 43 is somewhat adiabatically expanded and thereby cooled in the first expansion portion 44, but not so much so as to stop it reacting and/or mixing, and also is imparted with a substantial turbulence involving cyclic small pressure changes in this adiabatic expansion process, due to a shock wave which in some cases is formed just before or upstream of the constant cross section portion 45, when the pressure ratio between the stagnation point pressure (inlet side pressure) and the back pressure is appropriate. Subsequently as it flows along the constant cross section portion 45 keeping a substantially steady state condition of temperature and pressure the mixture reacts and/or mixes even better, due to this turbulence. Thus by this steady state but turbulent interval of temperature and pressure produced by the provision of the constant cross section portion 45, the reaction and/or mixing of the metal vapor and/or mist and the other element is very well promoted. Finally, this reacting and/or mixing mixture is adiabatically expanded in the expansion portion 44, being very quickly cooled by said expansion as explained previously. On the other hand, in the case that the pressure ratio between the stagnation point pressure (inlet side pressure) and the back pressure is such that no such shock wave is formed just before or upstream of the constant cross section portion 45, then a substantially steady state but not particularly turbulent condition of temperature and pressure is maintained by the mixture gas as it passes along said constant cross section portion 45, and similarly to the operation in the case of the convergent-divergent nozzle of FIG. 5 by this steady state interval of temperature and pressure produced by the provision of the constant cross section portion 45 the reaction and/or mixing of the metal vapor and/or mist and the other element is very well promoted. Finally, in the case of the convergent-divergent nozzle 41 shown in FIG. 7, formed with several such constant cross section portions 45 and 45', the above described process in the case of the convergent-divergent nozzle of FIG. 6 is repeated several times. It has been confirmed by experiments made by the present inventors that these processes are effective, provided that the axial length or lengths of the constant cross section portion or portions such as L, $L_1$, or $L_2$ is equal to or greater than the diameter D of the throat 43 of the convergent-divergent nozzle 41.

Now, the vapor pressures of different metals differ widely. The tendencies to react to oxygen, carbon, boron, or nitrogen of different metals also differ widely, and the pressure and temperature conditions under which mixtures of various metal vapors and such elements are stable as mixtures or as chemical combinations such as oxides, carbides, borides, or nitrides are also diverse. Further, the free energy of various compounds varies even under the same temperature and pressure conditions, and accordingly the behavior of the composition and reaction of various compounds is different even under the same temperature and pressure conditions. Therefore, when a mixture gas at a high temperature of a metallic vapor and/or mist and another element is converted into a compound in fine powder form by being rapidly cooled by being passed through a convergent-divergent nozzle with a constant cross section portion as described above, by properly selecting not only the temperature and the pressure conditions before and after the convergent-divergent nozzle but also the position and the axial length of the constant cross sectional portion, according to the tendency of the metal and the other element to be formed into metal particles and to be combined and/or mixed and according to the temperature and pressure conditions of stability of the resulting compound, the conversion into metallic particles with surface layers composed of compound of the metallic gas and/or vapor and the other element can be well promoted, and this allows for the production of very fine composite powder particles of the general type described above by fully taking advantage of the possibilities for varying the shape of the convergent-divergent nozzle according to its functions as described above.

MULTIPLE EXPANSION PORTION TYPE DIVERGENT NOZZLES

Figure 8:
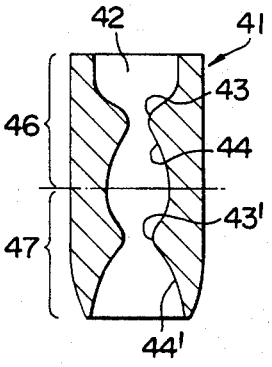
FIG. 8 is an axial sectional view, similar to FIGS. 5, 6, and 7, showing a convergent-divergent nozzle which has two throats and two expansion portions.
Figure 9:
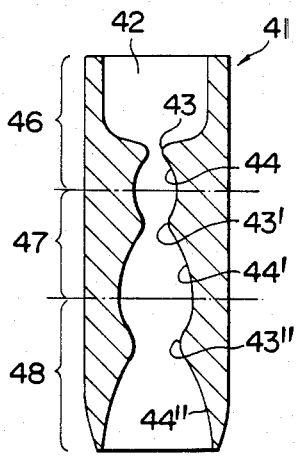
FIG. 9 is an axial sectional view, similar to FIGS. 5, 6, 7, and 8, showing a convergent-divergent nozzle which has three throats and three expansion portions.

The convergent-divergent nozzle 41 shown in FIG. 8 is composed of two throat and expansion portion or nozzle combinations 46 and 47, and has, in order along its axis, an inlet portion 42, a first throat portion 43 toward which the inlet portion 42 converges, a first expansion portion 44, a second throat portion 43' toward which the downstream end of the first expansion portion 44 converges, and a second expansion portion 44'. And the convergent-divergent nozzle 41 shown in FIG. 9 is composed of three throat and expansion portion or nozzle combinations 46, 47, and 48, and has, in order along its axis, an inlet portion 42, a first throat portion 43 toward which the inlet portion 42 converges, a first expansion portion 44, a second throat portion 43' toward which the downstream end of the first expansion portion 44 converges, a second expansion portion 44', a third throat portion 43'' toward which the downstream end of the second expansion portion 44' converges, and a third expansion portion 44''. In fact, depending upon the particular properties and nature of the fine powder which is to be produced, such a convergent-divergent nozzle having even more than three expansion portions could be utilized.

The following opinions are held as to why this particular convergent-divergent nozzle configuration is effective.

As a mixture gas consisting of metal vapor and/or mist and the other element to be compounded therewith enters into the inlet portion 42 of the convergent-divergent nozzle 41 shown in FIG. 8, according to sucking on the outlet thereof, it reaches a supersonic speed in the region of the first throat portion 43, then is adiabatically expanded in the first expansion portion 44, being very quickly cooled by said expansion as explained previously, but not so much as to stop it reacting and/or mixing. Provided that a shock wave is formed just before or upstream of the second throat portion 43', which can be ensured to occur when the pressure ratio between the stagnation point pressure (inlet side pressure) and the back pressure is appropriate according to proper tailoring of the operational parameters of the apparatus, strong turbulence will be generated in the mixture gas just as it enters the second throat portion 43'. This high turbulence persists as the mixture gas flows through the second throat portion 43' and through the second expansion portion 44'. By this high turbulence of the mixture gas, the reaction and/or mixing of the metal vapor and/or mist and the other element is very well promoted. Finally, this reacting and/or mixing mixture is adiabatically expanded in the second expansion portion 44', being very quickly cooled by said expansion as explained previously. In the case of the convergent-divergent nozzle 41 shown in FIG. 9, since it is formed with more than two such expansion portions, the above described process in the case of the convergent-divergent nozzle of FIG. 8 is repeated several times. It has been confirmed by experiments made by the present inventors that these processes are effective.

Although the present invention has been shown and described with reference to several preferred embodiments thereof, and in terms of the illustrative drawings, it should not be considered as limited thereby. Various possible modifications, omissions, and alterations could be conceived of by one skilled in the art to the form and the content of any particular preferred embodiment, without departing from the scope of the present invention. Therefore it is desired that the scope of the present invention, and of the protection sought to be granted by Letters Patent, should be defined not by any of the perhaps purely fortuitous details of the shown preferred embodiments, or of the drawings, but solely by the scope of the appended claims, which follow.

What is claimed is:

1. A method of making a composite material composed of fine powder particles embedded in matrix metal, each of the particles having a metallic core and a ceramic surface layer which is a compound of the metal composing said core and another element, the average value of the ratio of the thickness of the surface layer of a powder particle to the radius of the particle being substantially greater than 0.05, wherein said core metal in a gaseous form is mixed with said another element in the gaseous state, the resulting mixture being then passed through a convergent-divergent nozzle and being thereby rapidly cooled by adiabatic expansion, and blowing as a jet against the free surface of a molten mass of said matrix metal.

2. A method of making a composite material according to claim 1, wherein the average value of the ratio of the thickness of the surface layer of a powder particle to the radius of the particle is substantially greater than 0.1.

3. A method of making a composite material according to either one of claim 1 or claim 2, wherein the average diameter of the particles is substantially less than 5 microns.

4. A method of making a composite material according to either one of claim 1 or claim 2, wherein the average diameter of the particles is substantially less than 1 micron.

5. A method of making a composite material according to either one of claim 1 or claim 2, wherein said core metal is magnesium, so that the cores of the particles are made of magnesium, and said another element is oxygen, so that the ceramic outer layers of the particles are made of magnesium oxide, and wherein said matrix metal is magnesium.

6. A method of making a composite material according to claim 5, wherein the average diameter of the particles is substantially less than 5 microns.

7. A method of making a composite material according to claim 5, wherein the average diameter of the particles is substantially less than 1 micron.

8. A method of making a composite material composed of fine powder particles embedded in matrix metal, each of the particles having a metallic core and a ceramic surface layer which is a compound of the metal composing said core and another element, the average value of the ratio of the thickness of the surface layer of a powder particle to the radius of the particle being substantially greater than 0.05, wherein said core metal in a gaseous form is passed through a first convergent-divergent nozzle and is thereby rapidly cooled by adiabatic expansion, and is then mixed with said another element in the gaseous state, the resulting mixture being then passed through a second convergent-divergent nozzle and being thereby rapidly cooled by adiabatic expansion, and blowing as a jet against the free surface of a molten mass of said matrix metal.

9. A method of making a composite material according to claim 8, wherein the average value of the ratio of the thickness of the surface layer of a powder particle to the radius of the particle is substantially greater than 0.1.

10. A method of making a composite material according to either one of claim 8 or claim 9, wherein the average diameter of the particles is substantially less than 5 microns.

11. A method of making a composite material according to either one of claim 8 or claim 9, wherein the average diameter of the particles is substantially less than 1 micron.

12. A method of making a composite material according to either one of claim 8 or claim 9, wherein said metal is silicon, so that the cores of the particles are made of silicon, and said another element is carbon, so that the ceramic outer layers of the particles are made of silicon carbide, and wherein said matrix metal is magnesium alloy.

13. A method of making a composite material according to claim 12, wherein the average diameter of the particles is substantially less than 5 microns.

14. A method of making a composite material according to claim 12, wherein the average diameter of the particles is substantially less than 1 micron.

* * * * *